US008604722B2

(12) United States Patent
Roberts

(10) Patent No.: US 8,604,722 B2
(45) Date of Patent: Dec. 10, 2013

(54) PARTICLE BEAM COOLING DEVICE

(75) Inventor: Thomas J. Roberts, Batavia, IL (US)

(73) Assignee: Muons, Inc., Newport News, VA (US)

( * ) Notice: Subject to any disclaimer, the term of this patent is extended or adjusted under 35 U.S.C. 154(b) by 657 days.

(21) Appl. No.: 12/894,662

(22) Filed: Sep. 30, 2010

(65) Prior Publication Data

US 2011/0074287 A1 Mar. 31, 2011

Related U.S. Application Data

(60) Provisional application No. 61/247,181, filed on Sep. 30, 2009.

(51) Int. Cl.
*H01J 23/00* (2006.01)

(52) U.S. Cl.
USPC ..... 315/500; 315/505; 315/502

(58) Field of Classification Search
USPC ..... 315/5.34, 500–507, 5.39; 250/396 R; 378/145, 119
See application file for complete search history.

(56) References Cited

U.S. PATENT DOCUMENTS 5,077,774 A * 12/1991 Piestrup et al. ..... 378/119
5,113,423 A * 5/1992 Csonka ..... 378/145
5,138,271 A * 8/1992 Ikegami ..... 315/501

OTHER PUBLICATIONS

Yu Bao et al "Frictional Cooling for a slow muon source" Proceedings of IPAC 10 Kyoto Japan 2010 pp. 3452-3454.*
Greenwald et al A Muon collider scheme based on frictional cooling Proceedings of IPAC 10 Kyoto Japan 2010 pp. 1593-1595.*
Raphael Galea "Frictional cooling" MC collaboration meeting Jun. 11-12, 2003.*
Tilley et al; "Design and Expected Performance of the Muon Beam Line for the Muon Ionisation Cooling Experiment"; 2006; WEPLS002; pp. 2397-2399.
Mohl et al; "Beam cooling: principles and achievements"; Lawrence Berkeley National Laboratory; May 2003; 10 pages.
Michael Zisman; "Experimental Tests of Cooling: Expectations and Additional Needs"; 10$^{th}$ International Workshop on Neutrino Factories, Super beams and Beta beams; 2008; p. 1-5.
Johnson et al; "Recent Innovations in Muon Beam Cooling"; American Institute of Physics; 2006; pp. 405-414.
Green et al; "The Integration of Liquid and Solid Muon Absorbers into a Focusing Magnet of a Muon Cooling Channel"; 2003; Institute of Electrical and Electronics Engineers; pp. 1834-1836.

(Continued)

*Primary Examiner* — Daniel Cavallari
*Assistant Examiner* — Srinivas Sathiraju
(74) *Attorney, Agent, or Firm* — Williams Mullen

(57) ABSTRACT

This discloses a device called a particle refrigerator that will reduce the emittance of a charged particle beam. The particle refrigerator device is particularly well-suited for beams of particles created by interactions or decays of other particles, such as anti-protons, pions, ions, and muons, which are inherently created with very large emittances. It is a compact and inexpensive device compared to other systems for the emittance reduction of such beams. This device works by injecting beam particles backwards into the device, using the particle turn-around to match an incoming beam into a frictional cooling channel; this increases the acceptance of that channel by perhaps a thousandfold, making it practical to produce beams of high intensity and brightness. The frictional cooling is very effective, and simulations of its operation and performance give emittance reduction factors exceeding 30,000, with transmissions as high as 70%.

11 Claims, 2 Drawing Sheets

(56) References Cited

OTHER PUBLICATIONS

Mühlbauer et al; "Beam cooling by frictional forces: Monte Carlo calculations and design studies"; Hyperfine Interactions 82 (1993) pp. 459-467.

Mühlbauer et al; "Frictional cooling: Experimental results"; Hyperfine Interactions 119 (1999) pp. 305-310.

Abramowicz et al; "A Muon Collider Scheme Based on Frictional Cooling"; arXiv:physics/0410017v1 [physics.acc-ph] Oct. 2004; pp. 1-41.

Summers et al; "6D Muon Ionization Cooling with an Inverse Cyclotron"; Low Emittance Muon Collider workshop; FERMILAB: Feb. 2006; pp. 1-18.

Caldwell; "Frictional Cooling"; Presentation given at Fermilab Oct. 27, 2009; pp. 1-23.

Galea et al; "A Frictional Cooling Demonstration Experiment With Protons"; arXiv:physics/0311059v1 [physics.acc-ph] Nov. 2003; pp. 1-24.

D. Taqqu; "Compression and Extraction of Stopped Muons"; The American Physical Society; PRL 97, 194801; 2006; pp. 1-4.

R. Roberts et al; "Particle Refrigerator"; Muon Accelerators and Neutrino Factories; Proceedings of PAC09; WE6PFP096; pp. 1-3.

Yu et al; "Frictional Cooling Demonstration at MPP"; Proceedings of COOL 2009, Lanzhou China; TUM1MCCO03; pp. 1-5.

* cited by examiner

PARTICLE BEAM COOLING DEVICE

CROSS-REFERENCE TO RELATED APPLICATION

The present application claims the benefit of U.S. Provisional Patent Application No. 61/247,181, filed Sep. 30, 2009, the entire disclosure of which is hereby incorporated by reference.

STATEMENT REGARDING GOVERNMENT SUPPORT

None.

FIELD OF THE INVENTION

This application relates to charged particle beams in general and, more particularly, to particle beam cooling device, including preparing and producing low energy, high brightness beams of particles produced by interactions or decay of other particles.

BACKGROUND OF THE INVENTION

Charged particle beams generated via interactions or decays are created with very large emittances. This makes them very difficult to manipulate, so devices and techniques to reduce their emittance are highly desirable, especially to generate beams with high intensity and high brightness. The emittance of a beam is the volume of six-dimensional phase space that its ensemble of particles occupies, and Liouville's theorem limits the ability to change it. The phase density of the particle beam is preserved along the direction of motion of the particles within the beam. All available methods for emittance reduction are similar to thermodynamic cooling, in that the emittance (temperature) of the desired object is reduced while increasing the emittance (temperature) of some other object(s).

There are several general techniques for reducing the emittance of a charged particle beam.

"Stochastic cooling" uses variable electromagnetic fields and high-speed feedback to reduce the emittance of a beam. Unfortunately it requires many seconds to achieve a significant reduction, and is thus unsuitable for beams of unstable particles (such as pions or muons, which may have an at-rest lifetime of about 26 ns or 2.2 μs respectively). It also requires large and expensive apparatus.

"Electron cooling" uses an overlapping parallel beam of electrons to transfer the emittance of the desired beam to the electron beam. This, too, requires seconds to achieve a significant reduction, and is thus unsuitable for beams of unstable particles (such as pions or muons). It also requires large and expensive apparatus.

"Ionization cooling" involves directing a beam through a material that absorbs the energy of the incident particles (i.e., an absorber), thus reducing the momentum of each particle along its momentum vector, and then re-accelerating the beam longitudinally. This has the effect of reducing the transverse momentum of each particle in the beam (transferring it to the absorber), thus reducing the transverse emittance of the ensemble of all beam particles. This can happen quickly enough for beams of unstable particles, but conventional approaches in ionization cooling require large and expensive apparatus.

"Frictional cooling" is a specific type of "ionization cooling" that operates at low velocity, below about 0.02 times the speed of light (for particle beams this is quite slow). In this regime a faster particle loses more energy in an absorber, and a slower particle loses less energy. As the particle's energy is related to its speed, by alternating multiple absorbers and regions of re-acceleration, it is possible to create a channel with an equilibrium speed: each re-acceleration is matched to the energy lost in each absorber by a particle at the desired equilibrium speed. Slower particles lose less energy in the absorbers and are accelerated up to the equilibrium speed, while faster particles lose more energy in the absorbers and are slowed down to the equilibrium speed. At the same time, ionization cooling operates to reduce the transverse emittance of the beam. This can happen quickly enough for beams of unstable particles, and with small and relatively inexpensive apparatus. Unfortunately, the acceptance (i.e., the maximum value of beam emittance able to enter) of such a channel is quite small, as the panicles must have very low speed to enter it, so to date nobody has been able to use this for beams with high intensity or high brightness.

It would be advantageous to provide a relatively compact and inexpensive device to reduce the emittance of charged particle beams.

It would also be advantageous to provide a device well-suited for beams of particles produced by the interactions or decays of other particles, such as anti-protons, pions, ions, and muons.

It would further be advantageous to provide a device which operates very quickly, permitting use for unstable particles such as muons (lifetime of about 2.2 μs).

It would further be advantageous to provide a device with a large emittance reduction factor and with relatively high transmission.

It would further be advantageous to provide a device with large acceptance and the ability to produce beams of high intensity and brightness.

SUMMARY OF THE INVENTION

In accordance with the present invention, there is provided a device railed a particle refrigerator or particle beam cooling device that will reduce the emittance of a charged particle beam. The beam is matched to a frictional cooling channel, increasing its acceptance by perhaps a thousandfold, thus making it practical to generate high intensity and high brightness beams. An aspect of this approach, thus, is that the emittance of the beam is reduced, while that of the electrons inside an absorber is increased.

The particle refrigerator device is particularly well-suited for beams of particles created by the interaction or decay of other particles, such as anti-protons, pions, ions, and muons, which are inherently created with very large emittances. An aspect of the device is that it may be provided in embodiments that are compact and inexpensive in contrast with other systems for the emittance reduction of such beams.

The particle beam cooling device has a container defining a chamber and an external beam pipe in fluid communication with the chamber. The beam pipe is configured with respect to a first direction so as to receive beam particles and to admit them into the chamber as they travel along an input or first direction. There is a frictional cooling channel also in fluid communication with the chamber and configured along an output or second direction. The frictional cooling channel has an acceptance due to an absorber positioned within the chamber for reducing the average energy of the beam particles of the input beam.

A power supply is provided in conductive communication with a voltage distribution subsystem for distributing a voltage within the device with the subsystem in conductive communication with the absorber.

There is also a transverse focusing subsystem, for transversely focusing the beam particles within the device. The absorber, power supply, the voltage distribution subsystem and the transverse focusing subsystem are configured so as to reduce the average particle energy a desired amount to a second average particle energy, creating a particle turn-around within the chamber, and redirecting the input beam to a second direction as an output beam incident on the frictional cooling channel. Desirably the second average energy of the output beam particles substantially matches the acceptance of the frictional cooling channel. The external beam pipe is in fluid communisation with the chamber without a window.

The voltage distribution generates an electric field throughout the absorber. The absorber and electric field serve two purposes: (i) to slow down the incoming beam in the fast direction, reducing the beam particle's average energy a desired amount to a second average particle energy, and (ii) to comprise a frictional cooling channel for the outgoing beam in the second direction. The absorber, the high voltage and its distribution and the transverse focusing may be configured for the desired type of beam particles so that the beam particles turn around within the absorber. At turn around, they change from an incoming beam particle in a first direction to an outgoing beam particle in the second direction. The second average energy of the beam particles as they turn around matches the acceptance of the frictional cooling channel.

The absorber may be comprised of a plurality of planar conductive thin foils oriented in a perpendicular direction to the direction of the outgoing beam (second direction) and separated by a short distance and a voltage. The voltage distribution system is in conductive communication with the thin foils, making each one an equipotential surface where the potential differences between the adjacent thin foils generate the electric field to accelerate the outgoing beam particles in the second direction. This same electric field slows down the beam particles of the input beam moving in the first direction, as does the absorber.

The chamber and external beam pipe are configured to contain a vacuum which the absorber within has a plurality of planar film conductors positioned within the chamber. The planes are substantially orthogonal to the first direction for reducing the energy of the particles of the input beam incident on the conductors, where the conductors have an average thickness in the first direction. The voltage distribution subsystem is in conductive communication with the plurality of planar film conductors where the plurality of planar film conductors, the average thickness, the power supply, the voltage distribution subsystem, and the transverse focusing subsystem are configured so as (i) to reduce the average beam particle energy a desired amount to a second average particle energy, (ii) to create a particle turn-around within the chamber, and (iii) to redirect the input beam in a first direction to a second direction as an output beam incident on the frictional cooling channel. Again the second average energy of the output beam particles matches the acceptance of the frictional cooling channel.

The power supply, the voltage distribution subsystem, and the plurality of planar film conductors may be configured such that when a potential is applied from the power supply to the voltage distribution subsystem each of the plurality of planar film conductors is in an equipotential state. A transverse focusing subsystem may create an electromagnetic field, which may be used for the purpose of focusing the beam particles. The beam particles second direction may be substantially opposite the first direction.

The device absorber may have a continuous material distributed within the chamber including a plurality of electrodes disposed substantially perpendicular to the output beam within the continuous material within the chamber and the voltage distribution subsystem in conductive communication with the plurality of electrodes. The absorber, the voltage distribution subsystem, and the transverse focusing subsystem may be configured so as (i) to reduce the average particle energy a desired amount to a second average beam particle energy, (ii) to create a particle turn-around within the chamber, and (iii) to redirect the input beam to a second direction as an output beam incident on the frictional cooling channel allowing the second average energy of the output beam particles to match the acceptance of the frictional cooling channel.

The external beam pipe may be in fluid communication with the chamber without use of a window, and the beam pipe and the chamber are configured to contain a vacuum applied to the beam pipe and chamber.

The power supply, the voltage distribution subsystem, and the plurality of electrodes are configured such that when a potential is applied from the power supply to the voltage distribution subsystem, each of the plurality of electrodes is in an equipotential state (i.e., each of the electrodes has a surface at a consistent potential, even though individual electrodes will generally have different potentials.)

The transverse focusing subsystem with electrodes creates an electromagnetic field for focusing the particle beam and the second direction of the beam particle is substantially opposite the first direction.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

This device works by matching an incoming beam to a frictional cooling channel, and increasing the acceptance of that channel by perhaps a thousandfold, making it practical to produce beams of high intensity and brightness. A problem is that the acceptance of the frictional cooling channel is generally quite small, with an energy width of just a few kilo-electron-volts. An aspect of this device is to redirect the input beam particles inside the device to an outgoing or output beam (i.e., a particle turn-around), and then to direct the turned-around particles into the acceptance of an outgoing or output frictional cooling channel. By injecting the beam substantially backwards into the device (i.e., with respect to the ultimate, outgoing or output beamline), and having turned it around to exit the device through a frictional cooling channel, the effective energy acceptance of the device is approximately that of the high voltage used, which is on the order of several Mega-Volts in practice. So the device matches a beam with an energy spread of several Mega-electron-volts into the frictional cooling channel, which is roughly a thousand-fold increase in the acceptance. This makes it practical to handle high intensity beams, producing an output beam with very high brightness.

An embodiment of the invention, an example particular to anti-protons, may include a set of thin absorber foils (e.g., perhaps about 0.1 microns of carbon) separated by about a centimeter and a few kilo-Volt potential as a frictional cooling channel. Using about 1,000 foils, the required high voltage is several Mega-volts, so the device accepts a beam with an energy spread of several Mega-electron-volts, and reduces its emittance so at the output its energy spread is only a few kilo-electron-volts. The output beam emittance is determined by the properties of the frictional cooling channel, and can be enormously smaller than that of the input beam. Frictional cooling is very effective, and simulations give emittance reduction factors exceeding 30,000, with transmission as high as 70% (for anti-protons, the 30% loss of beam particles is primarily due to annihilation with nuclei in the foils).

Figure 1:
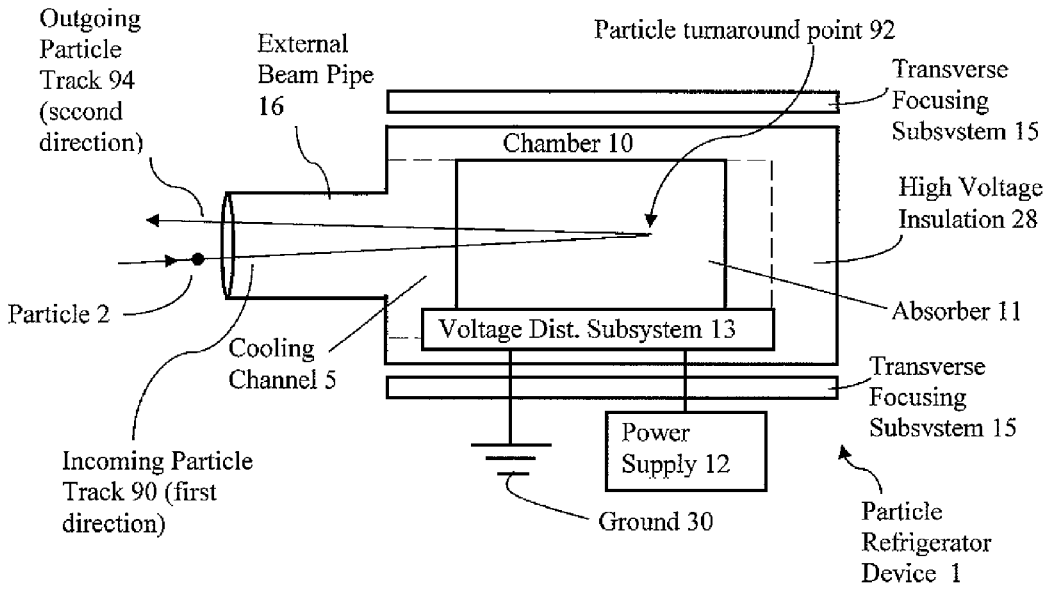
FIG. 1 is atop section view of a particle refrigerator device.

With reference to the drawings, FIG. 1 is a top section view of a particle refrigerator device 1. The key aspect of its operation is that beam particles 2 are injected backwards into the device 1; after turning around, beam particles 2 are usually within the acceptance of the outgoing or output frictional cooling channel 5. This device 1 effectively increases the acceptance of the cooling channel 5 about a thousandfold, permitting operation with beams of high intensity and brightness.

The device 1 may have a container or similar structure defining a chamber 10, which holds a vacuum as necessary for operation, and encloses the working elements of the particle refrigerator device 1. The vacuum within chamber 10 communicates with or connects directly (without window) to the vacuum inside the external beam pipe 16. A transverse focusing subsystem 15 may or may not be contained inside the chamber 10, and here is shown outside. Vacuum-tight insulating penetrations may be used for connections to a voltage distribution subsystem 13, and to the transverse focusing subsystem 15 if necessary.

The absorber 11 induces energy loss in all beam particles 2 that traverse it. Absorber 11 may be selected to optimize the energy loss in the frictional cooling channel 5, and to minimize scattering of the beam particles 2. The absorber 11 may be implemented as a set of thin foils 22 or planar film conductors (FIG. 2), or as a solid, liquid, or gas for a continuous absorber 24 (FIG. 3). The physical characteristics of the absorber 11 must be matched to the value of the high voltage supply 12 and the type of beam particle 2.

The voltage distribution subsystem 13 ensures that the high voltage of voltage supply 12 is distributed within the absorber 11 according to the design. It also acts as a current limiter to protect the components in the event of electrical discharge or sparking within the absorber 11. It is most likely implemented as a resistor divider with multiple taps for connections to each foil 22 or electrode 26. For example, a voltage potential across a resister divider type voltage distribution subsystem 13 may be divided from ground to −5.5 MV, with a first incident absorber foil being at −2 MV. A low cost example may employ two 50 kV sources as voltage supply 12 to create a 100 kV potential across voltage distribution subsystem 13.

The transverse focusing subsystem 15 may use a magnetic field or other means, such as electrostatic focusing to maintain or reduce the transverse size of the beam, keeping it within the transverse size of the absorber 11. It may be outside the chamber 10, as shown, or could be inside the chamber 10. Implementations can be as one or more solenoid magnets, as a series of quadrupole magnets, or in some embodiments as more complicated types of electromagnetic systems.

The high voltage supply 12 provides electrical power to the voltage distribution subsystem 13, in order to maintain the necessary accelerating voltage within the absorber 11 to create the frictional cooling channel 5. The value of the high voltage must be matched to the physical properties of the absorber 11 and to the type of the beam particle 2. The sign of the high voltage for the illustrated embodiments must be such that the desired beam particles 2 are accelerated to the left in the figures. The high voltage supply 12 is normally direct current, but in some applications it might be pulsed or alternating current The external beam pipe 16 may contain the vacuum and connects the external system to the particle refrigerator device 1 chamber 10; the vacuum is continuous, without windows (i.e., and in fluid communication.) It carries the beam particles into the particle refrigerator device 1, and back out again (with greatly reduced emittance). It is normally cylindrical, but in some applications may be another shape.

The high voltage insulation 28 separates the internal high voltage components from the chamber 10 and other objects at ground potential. The total insulation must be sufficient to prevent electrical breakdown; the vacuum itself provides part of the insulation required. High voltage connections and components outside the chamber 10 may be insulated individually (not shown). The electrical ground 30 may provide a reference for all electrical components.

The incoming particle track 90 is an example of how one beam particle 2 enters the particle refrigerator device 1 via the external beam pipe 16. In actual operation, there may be billions or trillions of beam particles 2 per second entering the particle refrigerator device 1, with a statistical distribution of trajectories and energies.

The particle "turn-around" 92 is a point within chamber 10 where a particular incoming particle track 90 loses all of its longitudinal momentum along the input direction and turns around. Thus the particle changes from a first direction incoming or input beam to a second direction outgoing or output beam at this point. Each beam particle 2 has its own particle turn-around 92, the location of which depends on its particular incoming trajectory and energy. Lower-energy incoming particles will turn around earlier (more to the left) and higher-energy incoming particles will turn around later (more to the right). An aspect of the device 1 is that after turning around, the beam particle 2 is usually within the acceptance of the outgoing or output frictional cooling channel 5, so most of the incoming beam particles 2 enter the outgoing or output channel and a high transmission rate can be achieved. The substantially opposite second direction is relative to the first direction, meaning that a beam particle moves generally reverse along the original or first direction beam line.

The outgoing or output particle track 94 is an example of how the same beam particle 2 exits the particle refrigerator device 1 via the external beam pipe 16. In actual operation, there may be billions or trillions of beam particles 2 per second exiting the particle refrigerator device 1, with a statistical distribution of trajectories and energies. As a design consideration for some embodiments, lie transverse cooling occurs for about every 2-3 thin foils 22 by a beam particle's 2 loss and regaining of energy within the frictional cooling channel 5, until the frictional cooling channel's equilibrium transverse emittance is achieved.

In the design stage for a particular implementation of the particle refrigerator device 1, all of the geometry and electrical properties of the components must be optimized for the specific beam particle 2 that this particle refrigerator device 1 is intended to handle. This includes the diameter, thickness, and material of the absorber 11, the configuration of the voltage distribution subsystem 13, the value of the high voltage supply 12, the strength of the transverse focusing subsystem 15, and the mechanical and electrical design of all components.

In the set-up stage for a particular implementation of the particle refrigerator device 1, the chamber 10 and external beam pipe 16 must be evacuated, the high voltage supply 12 tested, and the entire system must be tested for absence of electrical breakdown. Then some low-intensity test beam is injected into the particle refrigerator device 1 via the external beam pipe 16, and the high voltage supply 12 is tuned for optimum operation of the particle refrigerator device 1. This will preferably require external beam instrumentation (not shown).

In operation, each beam particle 2 enters the particle refrigerator device 1 via the external beam pipe 16 (e.g., traveling to the right in FIG. 1). Each beam particle 2 behaves essentially independently of all the other beam particles 2 in the incoming particle track 90 (there may be multi-particle and collective effects, but they are not relevant to this discussion of the operation of the device). The beam particle 2 is focused transversely by the transverse focusing subsystem 15, constraining it to travel within the absorber 11. As the incoming beam particle 2 traverses the absorber 11, it loses some energy, and as it propagates against the electric field it loses more energy, until it has lost all of its forward velocity and reaches its individual particle turn-around 92. After turning around, it becomes an outgoing or output particle traveling along the output particle track 94. As the outgoing or output particle traverses the absorber 11, it will lose energy, but it will regain that energy due to the electric field. This loss and gain may be carefully tuned during set-up so the beam particle 2 will quickly reach the equilibrium velocity of the frictional cooling channel 5. During the entire time the beam particle 2 is inside the particle refrigerator device 1, ionization cooling is operating to reduce its transverse momentum. The beam particle 2 exits the particle refrigerator device 1 via the external beam pipe 16. At that point, it has a speed very close to the equilibrium speed of the frictional cooling channel 5, and has greatly reduced transverse momentum. As a result, the output beam as a whole (i.e. the ensemble of individual beam particles) has greatly reduced emittance. For a good design, most of the beam particles 2 in the incoming or input particle track 90 will be in the outgoing or output particle track 94, yielding high transmission.

In a well-designed particle refrigerator device 1, transverse beam particle 2 losses are small, as are losses due to interactions with the absorber 11 material. Statistical variations in the individual beam particle's 2 energy loss can be large. The major losses of beam particles 2 are due to (i) beam particles 2 that lose too much energy in the absorber 11 and stop, and (ii) beam particles 2 that lose too little energy and accelerate out of the frictional cooling channel 5. In addition, for unstable beam particles 2, there may be losses due to decay. In some applications, the higher-energy output beam particles 2 that have accelerated out of the "frictional cooling" channel 5 may also be useful.

Figure 2:
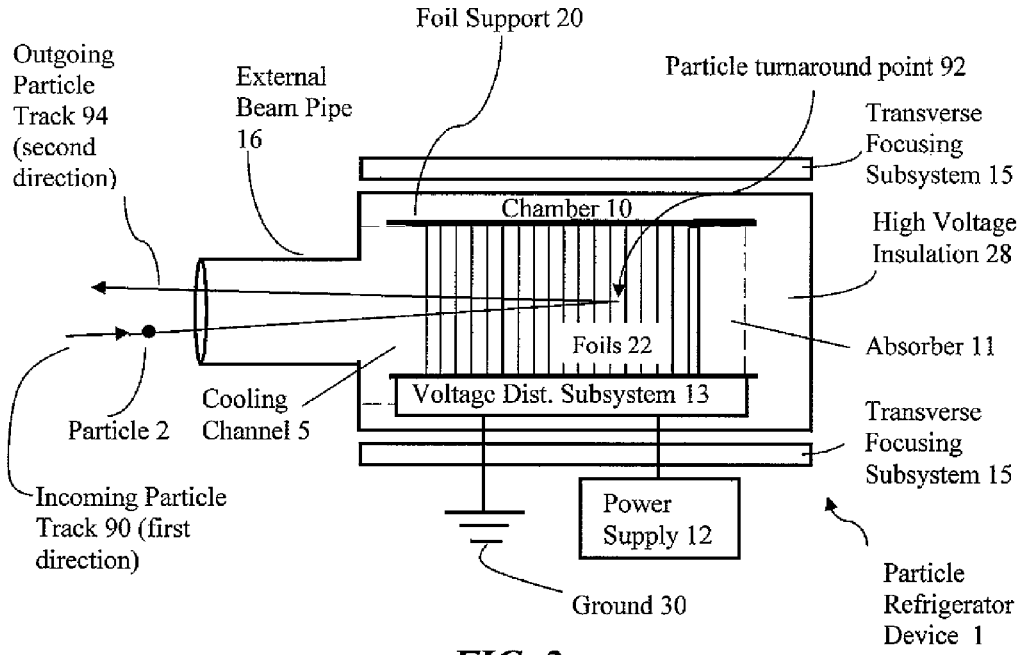
FIG. 2 is a top section view of a particle refrigerator device using a set of thin foils as the absorber; many more foils may be needed than the quantity shown.
Figure 3:
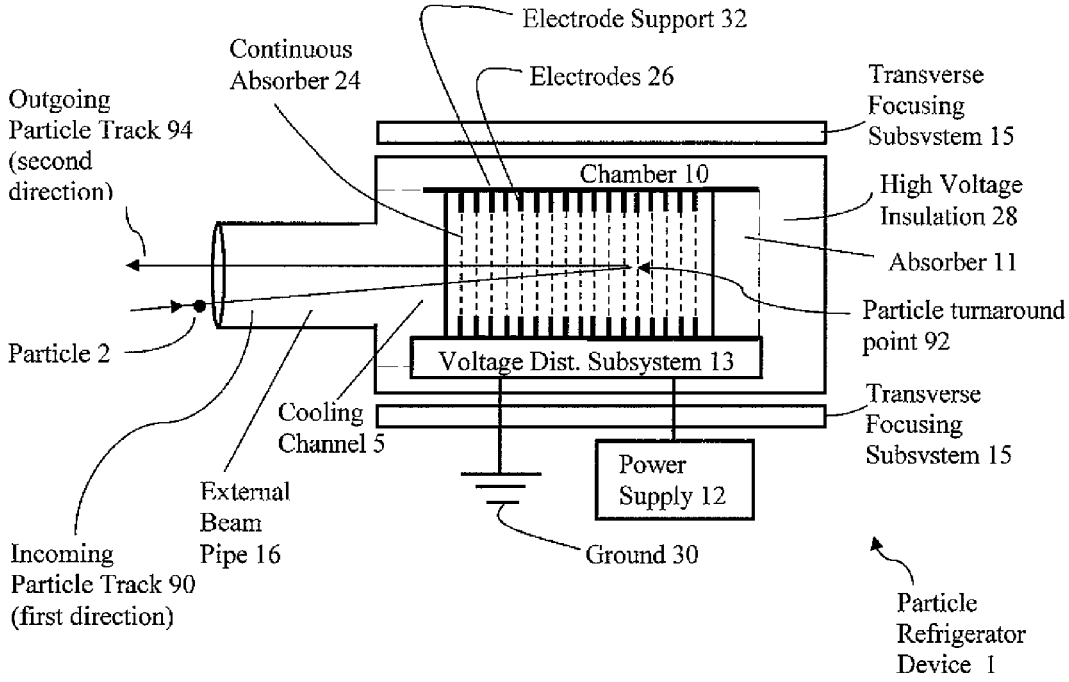
FIG. 3 is a top section view of a particle refrigerator device using a continuous absorber and a set of electrodes; more electrodes may be needed than the quantity shown.

A specific embodiment of this invention is shown in FIG. 2, which is a top section view of a particle refrigerator device 1 using a set of thin foils 22 as the absorber 11 of FIG. 1. The number of thin foils 22 shown is illustrative, and many more thin foils 22 may be needed than the quantity shown.

The following components are common to FIG. 1 and retain the same descriptions as above: chamber 10, voltage distribution subsystem 13, transverse focusing subsystem 15, high voltage supply 12, external beam pipe 16, high voltage insulation 28, electrical ground 30, incoming particle track 90, particle turn-around 92, outgoing or output particle track 94.

The foil support 20 provides mechanical support for each foil in the set of thin foils 22. It must be insulating, and may form part of the high voltage insulation 28. It is cylindrical with an axis common to that of the chamber 10, external beam pipe 16, and transverse focusing subsystem 15. The foil support 20 is normally cylindrical, but in some applications it might be some other shape.

The set of thin foils 22 implements the absorber 11 of FIG. 1. Thin foils 22 provide energy loss for the beam particles 2 of the beam, which enables the operation of the frictional cooling along the outgoing or output particle track 94, and increases the energy acceptance of the incoming beam particles 2. Each thin foil 22 may be circular and may be attached around its edge to the foil support 20. The thin foils 22 must be conductive so each one is in an equipotential surface state electrically. Equipotential means that each of the thin foils 22 has a surface at a consistent potential, even though individual thin foils 22 will generally have different potentials. Thin foils 22 are electrically connected to individual taps of the voltage distribution subsystem 13. The most suitable materials for the thin foils 22 are Carbon, Berylium, and Gold, but other materials are possible. The thin foil 22 thickness must be matched to the desired beam particles 2 in the beam, and matched to the potential difference between adjacent thin foils 22. In most implementations each thin foil 22 will be less than one micron thick. It may be necessary to provide a support grid for each thin foil 22; beam particles 2 in the frictional cooling channel 5 will stop if they hit the grid, but as they have very little transverse motion, aligning the grids for all the foils may make those losses acceptable. Each thin foil 22 is preferably circular, but in some applications might be some other shape. Additionally, the thin foils 22 are substantially perpendicular to the direction of the outgoing beam 94 and that along with the electric field provided by high voltage they implement the frictional cooling channel 5. Perpendicularity to the direction of the incoming beam 90 is incidental.

Several implementations of the particle refrigerator device 1 using thin foils 22 have been simulated using particle-tracking software. Designs for anti-protons have been achieved with 70% transmission (simulated). Designs for muons have been achieved with 15% transmission (many of the losses are particle decays, because the muons have a mean lifetime of only 2.2 microseconds). Emittance reduction factors exceeding 30,000 have been achieved in these simulations. Values for one embodiment of an anti-proton particle refrigerator device 1 design were simulated:

radius of thin foils: 100 mm
thickness of thin foils: 0.1 micron
material of thin foils: Carbon
number of thin foils: 200
spacing between thin foils: 10 mm
solenoid magnetic field: 1 Tesla
solenoid inside radius: 300 mm
solenoid length: 3 meters
chamber 10 inside radius: 299 mm
chamber 10 length: 3 meters
high voltage supply 12: 2 Mega-Volts The following components were not included in the simulation because they are not involved in particle tracking: high voltage insulation 28, foil support 20, resistor divider, external beam pipe 16, electrical ground 30.

An alternative embodiment of this invention is shown in FIG. 3, a top section view of a particle refrigerator device 1 using a continuous absorber 24 and electrodes. More electrodes may be needed than the quantity shown.

The following components are common to FIG. 2 and retain the same descriptions as above: chamber 10, voltage distribution subsystem 13, transverse focusing subsystem 15, high voltage supply 12, external beam pipe 16, high voltage insulation 28, electrical ground 30, incoming particle track 90, particle turn-around 92, and outgoing or output particle track 94.

The continuous absorber 24 implements or corresponds to the absorber 11 of FIG. 1. It provides energy loss for the particles of the beam, which is important for the operation of the "frictional cooling" channel 5 of the outgoing or output particle track 94 beam particle 2, and increases the energy acceptance of the incoming beam particle 2. The continuous absorber 24 may be a solid, liquid, or gas with the provision of suitable containment (not shown). The density of the continuous absorber 24 must be quite low, and must be matched to the desired beam particles 2; the energy loss between electrodes 26 must be matched to the potential difference between electrodes 26. The continuous absorber 24 must be selected so that high voltage breakdown does not occur in it, and any glow or other discharge is within the capacity of the high voltage supply 12 to maintain the required potential differences.

The set of electrodes 26 maintain equi-potential surfaces within the continuous absorber 24 to ensure a uniform electric field. They must be conductive, and can be either thin circular plates or rings (shown) surrounding the active region of the continuous absorber 24. They are connected to individual taps of the voltage distribution subsystem 13. Careful and detailed electrical design is required to determine their geometry and placement. Each electrode 26 is normally cylindrical, but in some applications might be some other shape.

The electrode support 32 provides mechanical support for each electrode in the set of electrodes 26. It must be insulating, and may form part of the high voltage insulation 28. It is cylindrical with an axis common to that of the chamber 10, external beam pipe 16, and transverse focusing subsystem 15. The electrode support 32 is generally cylindrical, but in some applications it might be some other shape.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A device for reducing the emittance of a charged particle input beam, the particles in the input beam having a first average particle energy while traveling along a fast direction, the device comprising:

a container defining a chamber;

an external beam pipe in fluid communication with the chamber; the beam pipe configured with respect to the first direction so as to receive the particles and to admit them into the chamber as they travel along the first direction;

a frictional cooling channel in fluid communication with the chamber and configured along a second direction, the frictional cooling channel having an acceptance;

an absorber positioned within the chamber for reducing the average energy of the particles of the input beam;

a power supply in conductive communication with a voltage distribution subsystem, for distributing a voltage within the device, the subsystem in conductive communication with the absorber;

a transverse focusing subsystem, for transversely focusing the particle beam within the device; and wherein the absorber, power supply, the voltage distribution subsystem, and the transverse focusing subsystem are configured so as to reduce the average particle energy a desired amount to a second average particle energy, to create a particle turn-around within the chamber, and to redirect the input beam to a second direction as an output beam incident on the frictional cooling channel, and wherein the second average energy of the output beam particles substantially match the acceptance of the frictional cooling channel.

2. The device of claim 1, wherein the external beam pipe is in fluid communication with the chamber without a window and the beam pipe and the chamber are configured to contain a vacuum.

3. The device of claim 1, wherein:

the chamber and external beam pipe are configured to contain a vacuum;

the absorber comprises a plurality of planar film conductors positioned within the chamber, with the planes substantially orthogonal to the first direction, for reducing the energy of the particles of the input beam incident on the conductors, the conductors having an average thickness in the first direction;

the voltage distribution subsystem is in conductive communication with the plurality of planar film conductors;

the plurality of planar film conductors, the average thickness, the power supply, the voltage distribution subsystem, and the transverse focusing subsystem are configured so as (i) to reduce the average particle energy a desired amount to a second average particle energy, (ii) to create a particle turn-around within the chamber, and (iii) to redirect the input beam to a second direction as an output beam incident on the frictional cooling channel; and the second average energy of the output beam particles match the acceptance of the frictional cooling channel.

4. The device of claim 3, wherein:

the power supply, the voltage distribution subsystem, and the plurality of planar film conductors are configured such that when a potential is applied from the power supply to the voltage distribution subsystem, each of the plurality of planar film conductors is in an equipotential state.

5. The device of claim 4, wherein the transverse focusing subsystem creates an electromagnetic field for focusing the particle beam.

6. The device of claim 4, wherein the second direction is substantially opposite the first direction.

7. The device of claim 1, further comprising:

wherein the absorber comprises a continuous material distributed within the chamber;

a plurality of electrodes disposed within the continuous material within the chamber;

wherein the voltage distribution subsystem is in conductive communication with the plurality of electrodes;

wherein the absorber, the voltage distribution subsystem, and the transverse focusing subsystem are configured so as (i) to reduce the average particle energy a desired amount to a second average particle energy, (ii) to create a particle turn-around within the chamber, and (iii) to redirect the input beam to a second direction as an output beam incident on the frictional cooling channel; and wherein the second average energy of the output beam particles match the acceptance of the frictional cooling channel.

8. The device of claim 7, further comprising wherein the power supply, the voltage distribution subsystem, and the plurality of electrodes are configured such that when a potential is applied from the power supply to the voltage distribution subsystem, each of the plurality of electrodes is in an equipotential state.

9. The device of claim 7, wherein the external beam pipe is in fluid communication with the chamber without a window and the beam pipe and the chamber are configured to contain a vacuum.

10. The device of claim 7, wherein the transverse focusing subsystem creates an electromagnetic field for focusing the particle beam.

11. The device of claim 7, wherein the second direction is substantially opposite the first direction.

* * * * *